US006058622A

United States Patent [19]

Sandor

[11] Patent Number: 6,058,622

[45] Date of Patent: May 9, 2000

[54] WETTING OF A POWDERY MATERIAL SUCH AS A BAGHOUSE DUST

[75] Inventor: Louis Sandor, Barrington, Ill.

[73] Assignee: AMSTED Industries Incorporated, Chicago, Ill.

[21] Appl. No.: 09/175,099

[22] Filed: Oct. 19, 1998

[51] Int. Cl.[7] ..... F26B 3/00

[52] U.S. Cl. ..... 34/339; 34/60; 34/380

[58] Field of Search ..... 34/359, 339, 360, 34/337, 577, 380, 585, 60, 557, 329; 261/118, DIG. 76, 94; 95/274, 279; 236/44; 110/301, 297, 306, 313

[56] References Cited

U.S. PATENT DOCUMENTS 3,939,881 2/1976 Scott ..... 141/91
5,000,624 3/1991 Steiger ..... 406/124
5,372,753 12/1994 Morton ..... 261/118
5,447,686 9/1995 Seidner ..... 422/26

*Primary Examiner*—Denise L. Ferensic
*Assistant Examiner*—Michelle A. Mattera
*Attorney, Agent, or Firm*—Edward J. Brosius; F.S. Gregorczyk; Stephen J. Manich

[57] ABSTRACT

The present invention relates to the wetting or providing moisture throughout a container of a powdery dry material such as an emission control baghouse dust. A collection hopper container is provided which usually comprises a box like structure with a sealable cover or top. A supply of low-pressure steam is provided to a plurality of conduits that extent through the cover and extend downwardly into the collected powdery material. By the injection of low-pressure steam through the plurality of conduits and outwardly into the powdery material through openings in the conduits, moisture is provided throughout the powdery material to lessen the dusty nature of the material to enable further processing to be accomplished more readily.

5 Claims, 1 Drawing Sheet

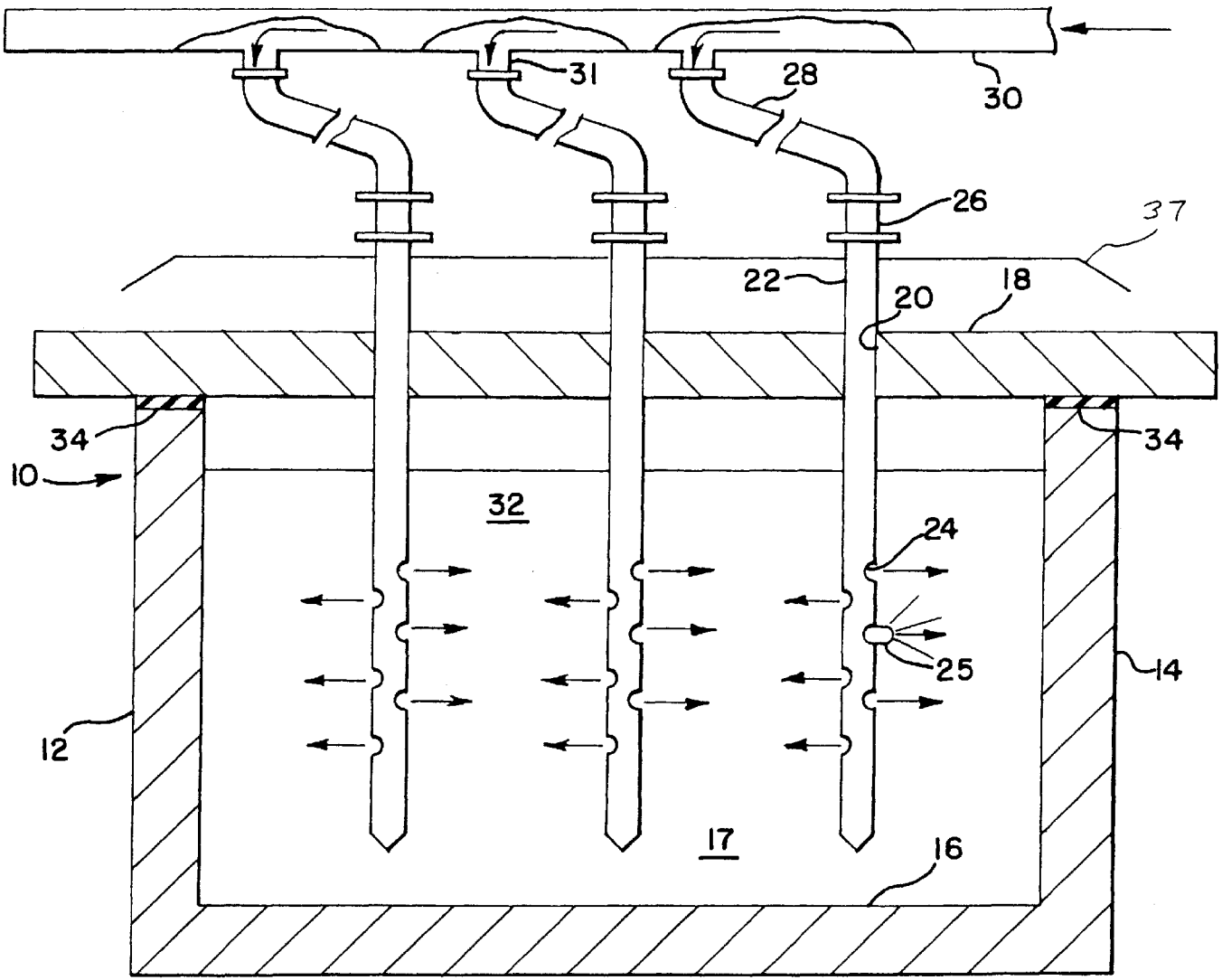
37
30
26
28
31
18
20
22
34
14
24
25
16
17
32
34
10
12

WETTING OF A POWDERY MATERIAL SUCH AS A BAGHOUSE DUST

BACKGROUND OF THE INVENTION

The present invention relates to the wetting of a powdery material to facilitate future handling and, more particularly, to providing of moisture through the injection of low-pressure steam into an accumulated powdery material such as a baghouse dust.

Disposal of powdery material such as baghouse dust presents special difficulties due to the extremely dry and fine powdery nature of such materials. Landfills are reluctant to accept such materials for ready landfilling due the generation of fugitive dust during treatment and the application of such materials into the landfill. In the case of dust which can have potentially hazardous characteristics due to the presence of heavy metals such as metal melting baghouse dust, the problem becomes even more severe. The exposure of baghouse dust handling workers and workers at the treatment facility or at the landfill becomes a concern due to the possible exposure to metals which may be present in the melting baghouse dust.

It is desirable to decrease the dusty quality or nature of such collected baghouse materials prior to their handling or treatment and especially prior to their application in a landfill. Due to the extremely small particulate nature of such powdery materials, an ordinary application of water is generally ineffective because water runs off the surface of such dust before it penetrates within the dust to provide proper moisturizing throughout the accumulated dust. Penetration by such materials as water is fractional into the depth of the accumulated material in a collection device such as a roll off hopper. However, very powdery and dry materials tend to loose their dusty quality after prolonged exposure to highly humid air or water vapor. Water vapor in particular seems to penetrate powder in a pervasive manner and once the vapor penetrates and is distributed throughout the powdery material, the dusty nature of the material is greatly reduced. Further, the condensed moisture seems to be retained by the dusty material for a long period of time to allow future handling without undue generation of fugitive dust.

It is an object of the present invention to provide an apparatus and method for providing moisture to a containerized powdery material.

It is also an object of the present invention to provide an apparatus and method for providing moisture to a dry powdery material accumulated in a container by the injection of low-pressure steam into the powdery material.

SUMMARY OF THE INVENTION

The present invention provides an apparatus and method for the injecting of moisture into an accumulated powdery material, usually in a container or dust collection hopper. It is especially adapted for the injection of moisture into an accumulated hopper of baghouse dust, in particular emission control dust from a metal melting operation.

Water vapor has been seen to provide good penetration through very powdery, small particulate dry materials to lessen the dusty quality of such materials. Such condensed moisture is also seen to be retained by the dust for a long period of time to reduce the ability of such dust to give off fugitive emissions during subsequent handling or treatment. The injection of water vapor in the form of steam is seen as the most efficient way of wetting or providing moisture throughout such an accumulation of powdery materials.

The configuration of FIG. 1 shows a method whereby low-pressure steam, either at a steady or pulsating pressure, is provided through a supply line to a header and in turn through a plurality of injection conduits or pipes. Each conduit would have a plurality of openings extending through its length which would extend usually vertically down into the powdery material within the collection hopper. It may also be desirable to place a specially designed nozzle over each opening in the steam supply conduit to improve dispersion of the steam throughout the powdery material.

The collection hopper itself would usually be a roll off container device having a sealable cover to lessen the potential for fugitive emissions to be given off during the steam injection process. It would of course, also be part of the present invention to provide injection conduits extending in other manners throughout the containerized collected powdery material. For example, a network of conduits distributed near the bottom of a hopper, in a plane parallel to the bottom, with a plurality of openings extending throughout the length would also provide a means for introducing steam to the powder. Introduction at this level would require the steam to travel upward because downward travel would be limited by the bottom of the hopper. The steam traveling upward would condense and thereby moisturize the powdery material. Additional steam that follows which has not given up enough heat to condense would reach the top surface or cover of the hopper where it could be collected by suitable exhaust equipment. By the time the rate of steam escaping from the dust and entering the exhaust equipment reaches an equilibrium, the dust in the hopper will have absorbed adequate moisture to mitigate the dusting tendencies.

An important part of the present invention is to provide for the proper dispersion of low-pressure steam throughout the collected dry powdery material in a manner such that proper moisturizing is provided so as to make further handling of the powdery material much easier due to the lesser tendency to give off fugitive emissions.

In fact, it is possible to distribute moisture into the dust using low-pressure steam without the network of conduits. In this case low-pressure steam in a pressure tight container would permeate the dust in the container. More time would be required and moisture distribution would be less uniform, but dusting tendencies would be reduced, which is of course the object of the invention.

BRIEF DESCRIPTION OF THE DRAWINGS

In the drawings, FIG. 1 is a cross sectional view of a dust collection hopper having a steam supply conduit arrangement in accordance with the present invention

DESCRIPTION OF THE PREFERRED EMBODIMENT

Referring now to FIG. 1 of the drawings, a dust collection hopper container is shown generally at 10. Such hopper 10 is seen to be of generally rectangular construction having end walls 12 and 14, bottom 16 and a separable removable top 18. Sidewalls are present to complete the structure but only sidewall 17 is visible due to the cross sectional nature of FIG. 1.

Dust collection hopper 10 is seen as nearly full of powdery material 32, which again is usually a baghouse emission control dust. Top 18 is seen to include three steam pipes or conduits 22 that extend through openings 20 in top 18. Such pipes are usually of metallic construction such as galvanized pipe and are able to be extended downwardly to near bottom 16 of container 10 such that openings 24 and steam pipe 22 are distributed throughout accumulated powdery material 32. It may also be desirable to provide special distribution nozzle such as shown at 25 to allow steam provided through steam pipe 22 to be distributed in a predetermined manner to allow the generally upward throughout accumulated powdery material 32.

Connection device 26 is seen to provide a rapid connection and disconnection between steam pipe 22 and steam supply hose 28. Steam supply hose 28 is usually of a flexible material to allow ease in positioning and connection to steam pipe connector 26. Low-pressure steam itself is provided from an outside source through steam supply header 30 to a plurality of discharge points 31 to which steam supply hoses 28 are connected.

It can be seen by viewing the simulated discharge of steam through steam pipe openings 24 that the arrangement of pipes extending through top 18 of dust collection hopper 10 can be so designed to allow the steam to be distributed outwardly and upwardly virtually throughout the entire volume of accumulated powdery material 32. As explained above, top 18 is removable from dust collection hopper 10. It should also be explained that a gasket or seal of a rubber like or pliable plastic material is provided at 34 to allow the generally air tight seal of top 18 onto the top surfaces of end walls 12 and 14 and side wall 17 and its corresponding side wall that is not shown in FIG. 1.

In operation, the low-pressure steam provided through steam supply header 30 would be usually at less than 3 psi and at a temperature of about 220° F. The nature of such low-pressure steam when emitted through steam pipe openings 24 is to be distributed outwardly and upwardly throughout the accumulated powdery material 32 in a manner that can be adjusted by the location and number of such steam pipes 22 and openings 24. The number of such steam pipes and steam pipe openings 24 can be adjusted to accommodate the general size of dust collection hopper 10 to assure the uniform nearly complete saturation with water vapor of powdery material 32. This leads to the generation of much less fugitive dust when powdery material 32 is handled in subsequent treatment or disposal operations such as distribution in a landfill. A collection hood 37 can be provided over the hopper if desired.

What is claimed:

1. A method of providing moisture throughout a powdery material in a container comprising the steps of:

accumulating a quantity of said powdery material in a container, having said container closed by sides, a top, and a bottom, providing a supply of low-pressure steam to said container and distributing said steam throughout said container such that said steam spreads throughout said powdery material thereby moisturizing said powdery material.

2. The method of claim 1 wherein said low-pressure steam is provided at a pressure of less than 3 pounds per square inch.

3. The method of claim 1 wherein said powdery material comprises baghouse dust from a metal melting operation, said low-pressure steam being provided through a plurality of pipes extending generally downwardly toward said bottom of said container, each of said pipes having a plurality of openings to provide a generally outward and upward dispersion of said low-pressure steam throughout said powdery material.

4. The method of claim 3 wherein each of said pipe openings includes a nozzle to allow dispersion of said steam outwardly at a predetermined pattern.

5. The method of claim 3 wherein each of said pipes include a section passing through said container top and an end connected to a steam supply conduit.

* * * * *